US009062409B2

(12) United States Patent
Cennon

(10) Patent No.: US 9,062,409 B2
(45) Date of Patent: Jun. 23, 2015

(54) FORCED CONVECTION HANGING CLOTHES DRYER

(76) Inventor: Stan Cennon, Huay Yai (TH)

( * ) Notice: Subject to any disclaimer, the term of this patent is extended or adjusted under 35 U.S.C. 154(b) by 409 days.

(21) Appl. No.: 13/808,164

(22) PCT Filed: Nov. 3, 2011

(86) PCT No.: PCT/IB2011/054900
§ 371 (c)(1),
(2), (4) Date: Jan. 3, 2013

(87) PCT Pub. No.: WO2013/064862
PCT Pub. Date: May 10, 2013

(65) Prior Publication Data
US 2014/0157614 A1 Jun. 12, 2014

(51) Int. Cl.
*D06F 58/10* (2006.01)
*D06F 58/20* (2006.01)
*F26B 21/00* (2006.01)

(52) U.S. Cl.
CPC ..... *D06F 58/10* (2013.01); *F26B 21/00* (2013.01); *D06F 58/20* (2013.01)

(58) Field of Classification Search
CPC ..... D06F 58/10; D06F 58/12; D06F 58/14; D06F 58/16; D06F 59/00; D06F 59/02; D06F 59/04; D06F 59/06; D06F 59/08; Y10S 224/927; A47L 23/00; F26B 21/006; A47B 53/00
See application file for complete search history.

(56) References Cited

U.S. PATENT DOCUMENTS

| | | | | |
|---|---|---|---|---|
| 2,660,806 | A * | 12/1953 | Whitesel | 34/77 |
| 4,682,424 | A * | 7/1987 | Irving | 34/621 |
| 5,199,188 | A * | 4/1993 | Franz | 34/105 |
| 5,546,678 | A | 8/1996 | Dhaemers | |
| 6,018,885 | A * | 2/2000 | Hill | 34/202 |
| 8,166,667 | B1 * | 5/2012 | Lora | 34/202 |
| 8,245,414 | B2 * | 8/2012 | Watson et al. | 34/381 |
| 8,322,169 | B2 * | 12/2012 | Kendall et al. | 68/13 R |
| 8,978,266 | B2 * | 3/2015 | Williams | 34/104 |
| 2005/0204579 | A1 * | 9/2005 | Rosseau et al. | 34/104 |
| 2007/0151129 | A1 * | 7/2007 | McAllister et al. | 38/3 |
| 2010/0122961 | A1 * | 5/2010 | Moreau | 211/85.7 |
| 2012/0192596 | A1 * | 8/2012 | Hall | 68/19 |
| 2012/0317729 | A1 * | 12/2012 | Song et al. | 8/137 |

FOREIGN PATENT DOCUMENTS

CN 2157212 Y 2/1994

* cited by examiner

*Primary Examiner* — David J Laux
(74) *Attorney, Agent, or Firm* — Maxey Law Offices, PLLC; Stephen Lewellyn

(57) ABSTRACT

A clothes dryer has a cabinet forming a drying chamber and a drying rack slidably mounted to the cabinet and movable between a retracted position where the drying rack is within the drying chamber and an extended position where the drying rack is exteriorly of the cabinet. A removable dividing panel is retained by the drying rack and divides the drying chamber into two horizontal and vertically extending drying chambers. A control system associated with the dryer has selectable modes to operate the divided drying chambers independently or concurrently as a single large drying chamber. A recycle system associated with the dryer permits recycling of heat air to increase drying efficiency.

3 Claims, 11 Drawing Sheets

FORCED CONVECTION HANGING CLOTHES DRYER

BACKGROUND OF THE INVENTION

This invention generally relates to clothes dryers, and in a representatively illustrated embodiment thereof, more particularly relates to a specially designed forced convection hanging clothes dryer and associated control system.

Tumble clothes dryers are well known in the field and are commonly used to dry wet clothing by continuously rotating the clothing in a drum while passing heated or unheated air through the drum. Conventionally, all tumble dryers operate on this same principle of rotating the clothing in an attempt to expose more surface area of the clothing to the heated air circulated through the drum to dry the clothing. It is known this combination of rotating and heating damages the clothing. The damage is particularly a result of the mechanical friction applied to the clothing fabric as it is tumbled. This damage can be further exaggerated by excessively drying the clothing. In recent years, there have been efforts made to reduce over drying by utilizing various sensors, such as moisture sensors and temperature sensors to monitor the wetness or dryness of the clothing to control the drying cycle. However, these controls are still prone to problem and do not eliminate the tumbling of the clothes.

Additionally, the efficiency of tumble dryers is relatively low and a significant percentage of energy is expended in drying a single load of clothing. A significant percentage of the energy is consumed through the operation of the drum driving motor and the blower or fan, and a great deal of the energy consumption is from the heating of the air circulated through the drum. Conventionally, room air is drawn into the dryer and across a heating element. The heated air is then passed through the drum and exhausted from the dryer. Because of the relatively short contact time between the heating element and the room air and between the heated air and the clothing, oversized heating elements are utilized to ensure the air is heated to a high enough temperature to facilitate drying. In many cases, air is over heated, and excess energy is wasted, due to the insufficient saturation of the air, being vented, which is partly due to the short time the air is inside the dryer before being vented While tumble dryers utilizing gas burners are more energy efficient than those utilizing electrical heating elements, both expend far more energy than otherwise would be consumed by a device that controllably heats and recirculates the air and does not include a rotating drum.

Still yet, tumble dryers have further drawbacks including creating a static charge between the clothing, also popularly referred as "static-cling" and wrinkling clothing that has been left unattended, even for a short period of time, within the drum of the dryer after a drying cycle.

Cabinet clothes dryers are also known in the field and operate similar to tumbler clothes dryers in the respect that heated or non-heated air is circulated across the clothing to promote drying. The main difference between the two dryers is the cabinet clothes dryer does not include a rotating drum and the clothes are either laid flat or hung. While conventional cabinet clothes dryers overcome the drawback of tumbling clothing associated with tumble clothes dryers, they are not devoid of drawbacks. Particularly, existing cabinet clothes dryers suffer from the uncontrolled mixing of recirculated air with room air. Additionally drawbacks include methods utilized for hanging clothing, and further, being of a single cabinet construction wherein all of the clothing are subjected to the same drying cycle regardless of the possible different drying requirement between the clothing.

SUMMARY OF THE INVENTION

Embodiments of the present invention provide a forced convection hanging clothes dryer that eliminates one or more of the aforementioned disadvantages present in tumble clothes dryers and cabinet clothes dryers and other inherent disadvantages therein.

Embodiments of the present invention further provide a forced convection hanging clothes dryer including a drying chamber that is divided into two or more separate drying chambers each of which have separately controlled blower or fan elements and heating elements associated therewith.

Embodiments of the present invention further provide a forced draft hanging clothes dryer include clothing hangers that permit airflow therethrough.

Embodiments of the present invention further provide a forced draft hanging clothes dryer including positionable clothing hangers permitting proper spacing between adjacently hung articles of clothing or other fabric articles.

Embodiments of the present invention further provide improvements to drying cycle control by utilizing temperature and moisture or humidity sensors in novel control methods.

Embodiments of the present invention provide a forced draft hanging clothes dryer having a control mode and a sequence that operates the dryer to cycle between air-recycle and air purge to ensure air is sufficiently saturated with moisture before being purged, which increases the energy efficiency of the dryer.

Embodiments of the present invention provided a forced draft hanging clothes dryer including a control system that permits programing of the starting time of the dryer to take advantage of lower electricity rates, thereby further lowering the cost to the user, and the user does not have to be present when the drying cycle finishes An advantage of the present invention is found in the separate drying chamber aspect. The chambers are sized so that, each one can accommodate an amount of normal laundry from a fully loaded normal sized washing machine. This is a major improvement, on any type of design with a single chamber, since drying can sometimes take longer than another washing cycle, and thereby hold up, the normal course of washing and drying several loads. By using each chamber to hang clothing as washing is completed, it is highly likely that this dryer can keep up to any number of washing cycles, since one chamber should almost always be finished by time another load of washing is completed. Conversely, by having multiple chambers instead of one very large chamber, it is easier and more economical to dry small, less than full loads, and with the many programming features that would be available; a user can customize a drying cycle to accommodate this type of usage.

To achieve these and other advantages, in general, in one aspect, a forced convection hanging clothes dryer is provided. The dryer includes a cabinet having an interior drying chamber. A drying rack is slidably mounted to the drying cabinet and moveable between a retracted position wherein the drying rack is disposed within the interior drying chamber and an extended position wherein the drying rack is disposed exteriorly of the interior drying chamber, the drying rack configured to removably receive and retain a drying chamber dividing panel in a vertical orientation so as to divide the drying rack horizontally into two separate sections. A drying chamber dividing panel is removably receivable by the drying rack and sealing divides the interior drying chamber into separate horizontally disposed and vertically extending first and second drying chambers when the drying chamber dividing panel is received by the drying rack and the drying rack is in the retracted position.

In general, in another aspect, the dryer includes a cabinet having an interior drying chamber, a forced draft fan, an ambient air duct configured to deliver ambient air exteriorly of the cabinet to the forced draft fan, an ambient air duct damper disposed across the ambient air duct and operable to permit or preclude the flow of air through the ambient air duct, an exhaust duct configured to exhaust air from the interior drying chamber to a position exteriorly of the cabinet, an exhaust duct damper disposed across the exhaust duct and operable to permit or preclude the flow of air through the exhaust duct damper, a recycle air duct configured to deliver air interiorly of the interior drying chamber to the forced draft fan, a recycle air duct damper disposed across the recycle air duct and operable to permit or preclude the flow of air through the recycle air duct. The ambient air duct damper and the recycle air duct damper operate 100% inversely to one another, which means, that when one is fully closed, the other is fully open, during any preprogrammed settings requiring heat application as part of the drying process.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
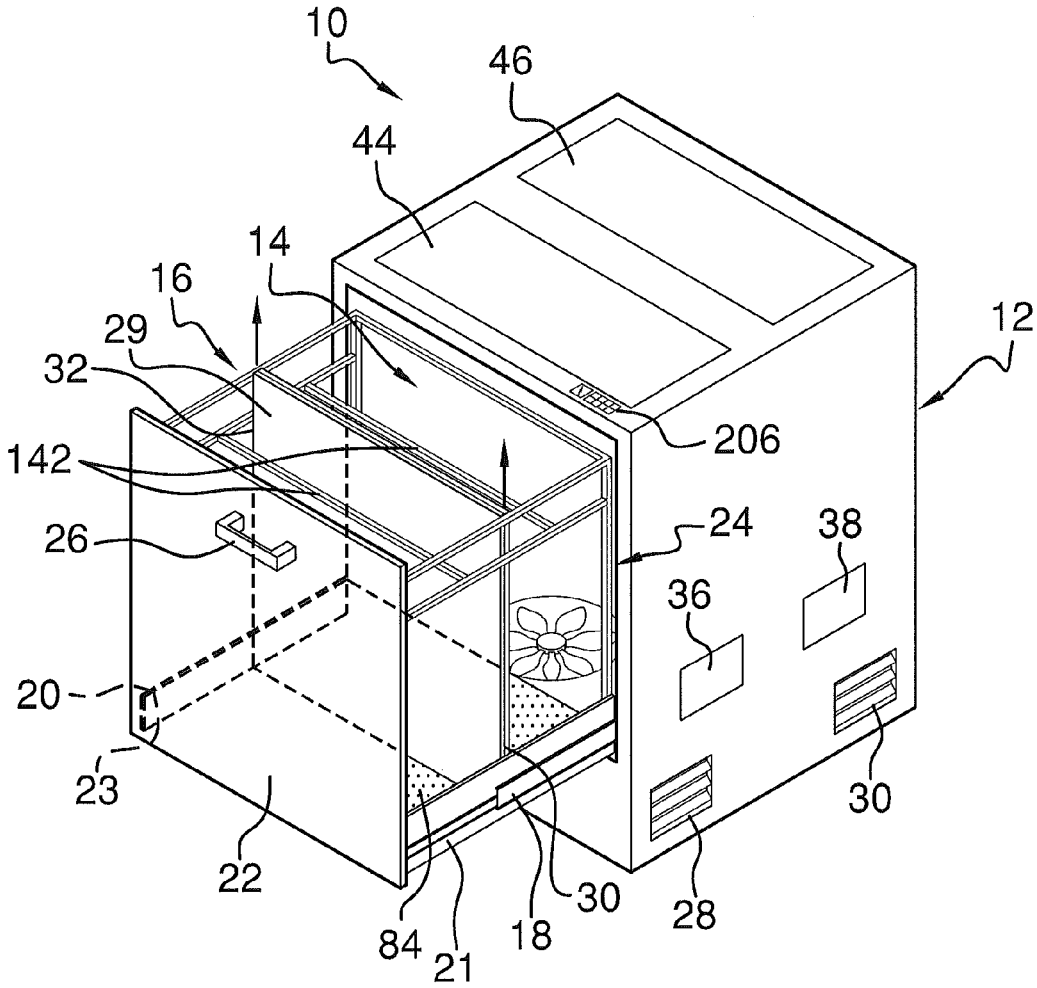
FIG. 1 is a diagrammatic front perspective view of a forced convection hanging clothes dryer constructed in accordance with the principles of at least one embodiment of the present invention shown with a drying rack in an extended position to illustrate details thereof.
Figure 2:
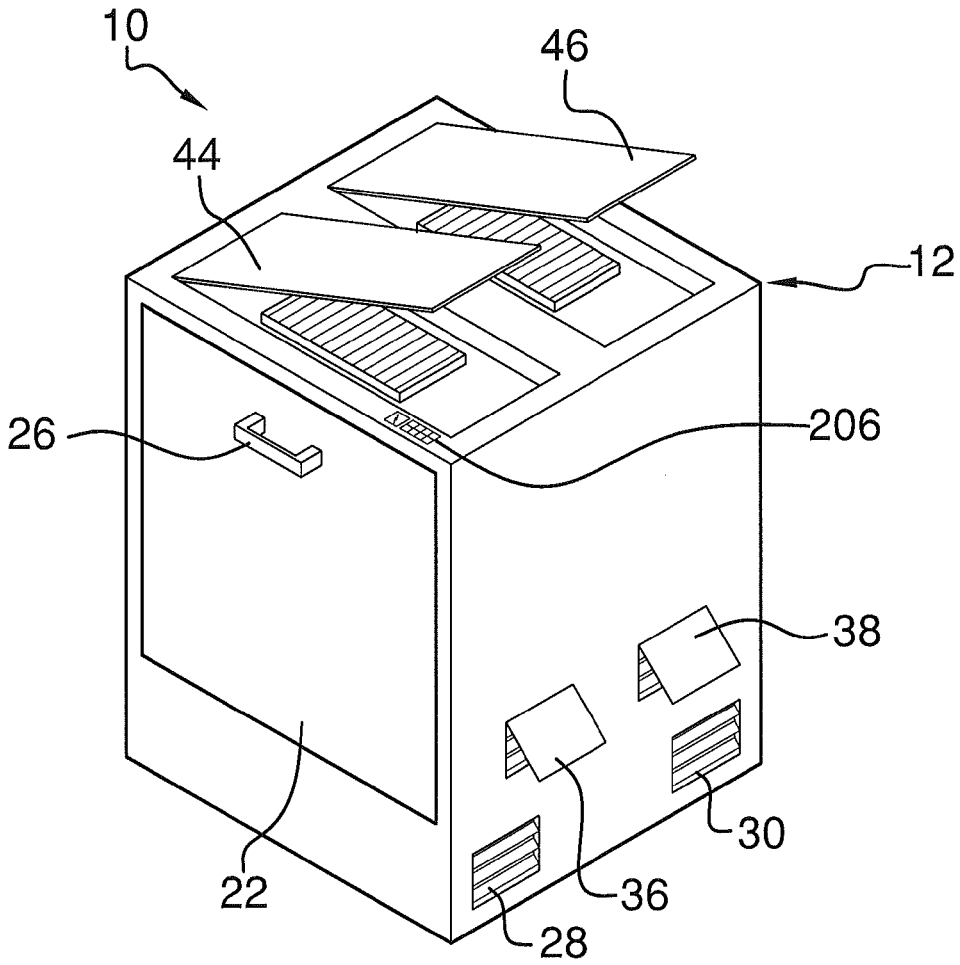
FIG. 2 is a diagrammatic front perspective view of a forced convention hanging clothes dryer constructed in accordance with the principles of at least one embodiment of the invention.
Figure 3:
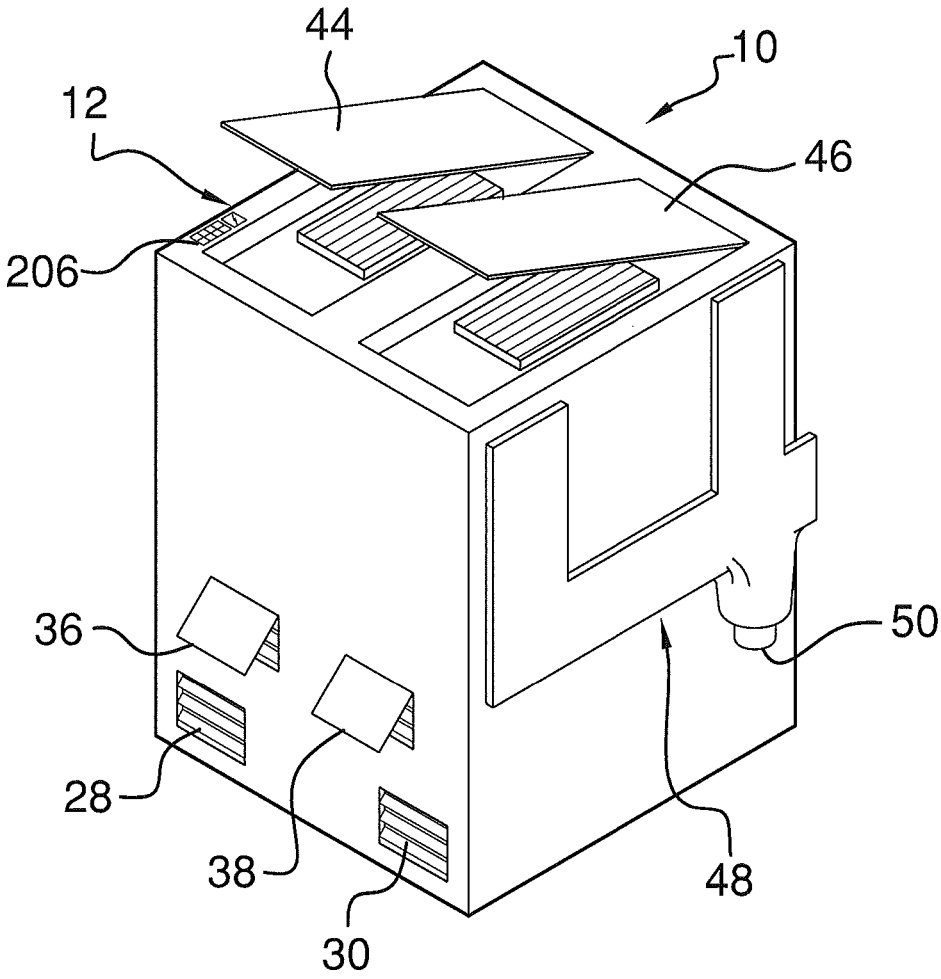
FIG. 3 is a diagrammatic rear perspective view of a forced convention hanging clothes dryer constructed in accordance with the principles of at least one embodiment of the invention.

Turning first to FIGS. 1 to 3, clothes drying apparatus representatively embodying principles of this invention is designated generally by reference numeral 10. Dryer 10 includes a vertically elongated cabinet 12 having an interior drying chamber 14 in which to receive clothing or other articles to be dried by the dryer. A drawer with drying rack 16 is slidably mounted to the cabinet 12 by left and right drawer rails 18 and 20 and is slidably between a retracted position where the drying rack is disposed within the drying chamber 14 of the cabinet (FIG. 2) and an extended position where the drying rack is disposed exteriorly of the cabinet (FIG. 1). The extended position permits user access to the drying rack for hanging articles to be dried, and for positioning or removal of all hanging devices. The drying rack 16 is consists of an open frame comprised of interconnected vertically orientated frame members and horizontally orientated frame members. The drying rack 16 includes a bottom panel 84 and side panels 21 and 23. As will be further discussed, the bottom panel 84 is perforated with a desired hole pattern to permit the flow of air through the bottom panel during a drying operation.

A cabinet door panel 22 is attached to the drying rack 16 and seals the opening 24 of the cabinet 12 when the drying rack is slid completely into the drying chamber 14 of the cabinet. The door panel 22 is fitted with a handle 26 for grasping by user during sliding of the drying rack 16.

As will be further discussed in detail below, a dividing panel 29 is removably received and retained by the drying rack 16 by opposite vertical side frame members 30 and 32. The dividing panel 29 vertically divides the drying rack 16 into forward and rearward clothes receiving areas. The dividing panel 29 further vertically divides the drying chamber 14 into two corresponding drying chambers when drying rack 16 is received within the drying chamber.

While not illustrated, appropriate air seals are positioned about the perimeter of the dividing panel to provide a sealing contact between the relative components as necessary. It is intended that there air seals will be of a soft material sealing components that are attached to the drying rack 16, at the center section, and will move in and out with the drying rack. There will be opposite fixed to the internal walls, soft sealing components, that will overlap the moveable sealing components and when the drawer is put into its closed position, it will effect a tension, or crush sealing mating of the soft seal components. In this way, there will be insignificant air transfer between drying chamber chambers.

Figure 4:
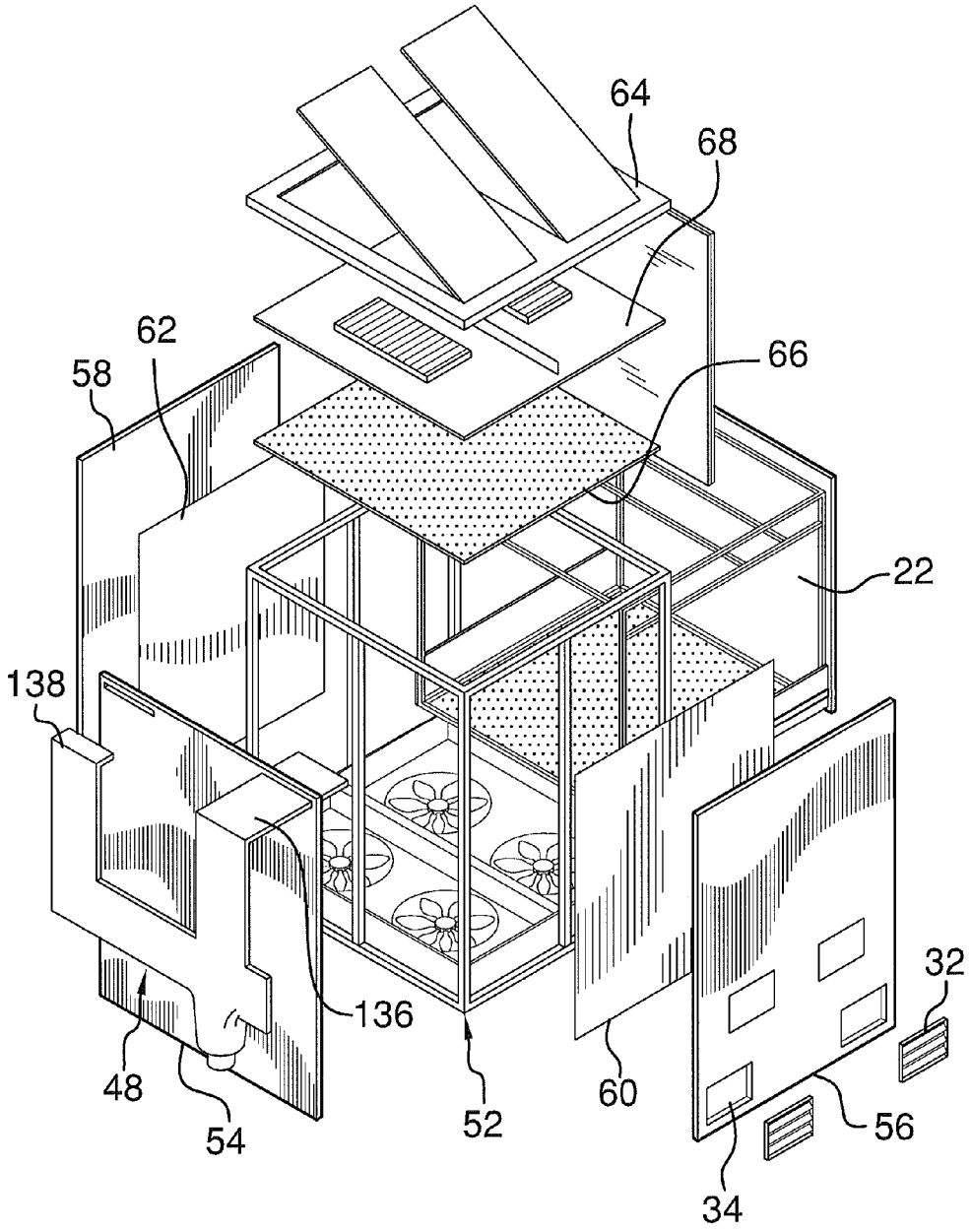
FIG. 4 is a diagrammatic, exploded rear perspective view of a forced convention hanging clothes dryer constructed in accordance with the principles of at least one embodiment of the invention.

Also, as will be further discussed below, cabinet 12 includes side mounted room air inlet vents 28, 30, 32, 34 adjacent its bottom end. While only vents 28 and 30 are shown here, vents 32 and 34 are correspondingly located on the opposite sides, as seen in FIG. 4. Component access panels 36 and 38 may be provided to permit access to the lower interior portion of the cabinet through the side for servicing the dryer. While not illustrated here, similar component access panels 40 and 42 may be corresponding disposed on the opposite side. Additional component access panels 44 and 46 may be provided at the top of the cabinet 12 to provide similar access for servicing the dryer. The cabinet 12 further includes a rear mounted exhaust duct assembly 48 through which discharge air may be exhausted from the dryer 10. Duct assembly 48 includes a duct coupling 50 for connection to standard dryer ducting for exhausting the air at a desired location, e.g. exteriorly of the building. Further illustrated is a control keypad 206 for interfacing with and controlling the various functions and operations of the dryer 10.

Turning now to FIG. 4, there is illustrated a diagrammatic exploded view of a representative embodiment of the dryer 10. Cabinet 12 of the dryer 10 includes a frame assembly 52 comprising of interconnected vertically orientated and horizontally orientated frame members configured for the attachment and support of the various components forming the dryer. As shown here, the cabinet 12 includes an exterior back panel 54, exterior side panels 56 and 58, interior side panels 60 and 62, exterior top panel 64, interior top panel 66, top divider panel 68 and door panel 22 (forming a front panel of the cabinet). The exterior panels and center dividing panel are appropriately heat insulated to increase the drying and energy efficiency of the dryer 10, and to lessen thermal transmission from between drying chambers. As will be discussed further below, side panels 56 and 60 are attached to and are supported by frame 52 in a horizontally spaced relation forming a first and second right side recycle air ducts therebetween. Similarly, side panels 58 and 62 are attached to and are supported by frame 52 in a horizontally spaced relation forming a first and second left side recycle air ducts therebetween. It is understood while the cabinet 12 is illustrated as comprising a frame assembly 52 and various separate panels that are attached to the frame to form the cabinet, various other constructions of the cabinet could be employed without departing from the scope of the embodiments of the invention. Accordingly, cabinet 12, as illustrated herein, is a representative and exemplarily construction.

Figure 5:
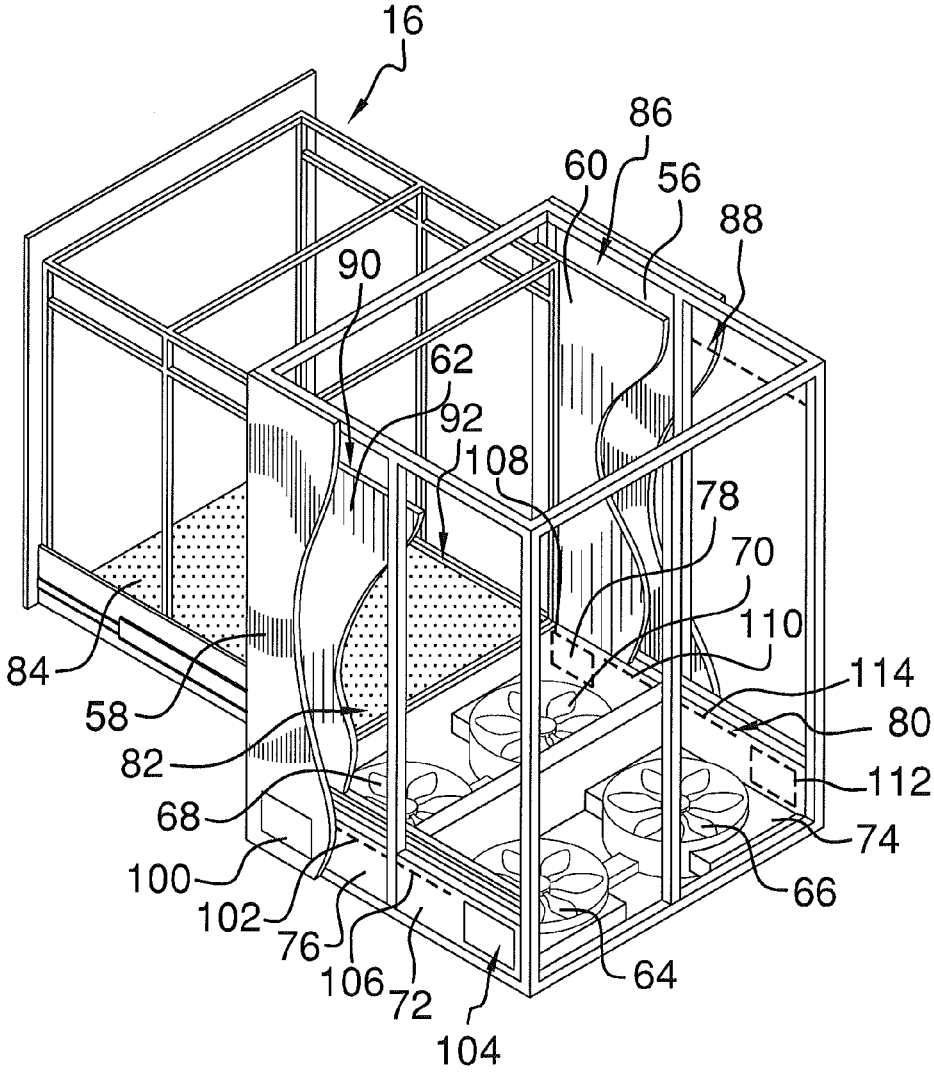
FIG. 5 is a diagrammatic rear perspective view of a forced convention hanging clothes dryer constructed in accordance with the principles of at least one embodiment of the invention illustrating a bottom plenum with panels removed for the purpose of illustrative clarity.

Referring now to FIG. 5, dryer 10 illustrated with the top panels 64, 66, 68 and the back panel 54 removed and the side panels 56, 58, 60 and 62 partially removed for purposes of illustrative clarity. Inlet air plenums 80 and 82 are disposed at a bottom end of the cabinet 12 and are separated by a vertical dividing wall 84. Dividing wall 84 is positioned to correspond with and to lie in the same vertical plane as the removable dividing panel 29 (not illustrated) when the drying rack 16 is completely slid inwardly into the drying chamber 14. It should be apparent dividing wall 84 remains stationary, and does not move in or out with the drawer assembly. Air plenum 80 houses forced draft fans 64 and 66 and corresponding air ducts 72 and 74. Air plenum 82 houses forced draft fans 68 and 70 and corresponding air ducts 76 and 78. Draft fans 64, 66, 68, 70 may be variable speed fans having a low, medium and high fan speed setting. Further illustrated is the drying rack 16 in the extended position. The bottom panel 84 of the drying rack 16 forms a ceiling of air plenums 80 and 82 when the drying rack is slid into the cabinet 12. It can be further seen here that the bottom panel 84 is ribbed to prevent articles that may fall onto the bottom panel from completely blocking the air holes extending through the bottom panel. The ribbing itself will be noticeable, from the way it undulates from the horizontal plane. The ribbing of the bottom panel is also perforated with strategically sized and placed holes that allow air from each fan to be admitted into the chamber in an even and consistent flow pattern. Since both fans always run on each of selected automatic programs, the air flow will always be uniform. The holes will also be placed on the undulations, so that air is coming up into the chamber from various angles, and ensuring that there are no dead flow areas.

Figure 6:
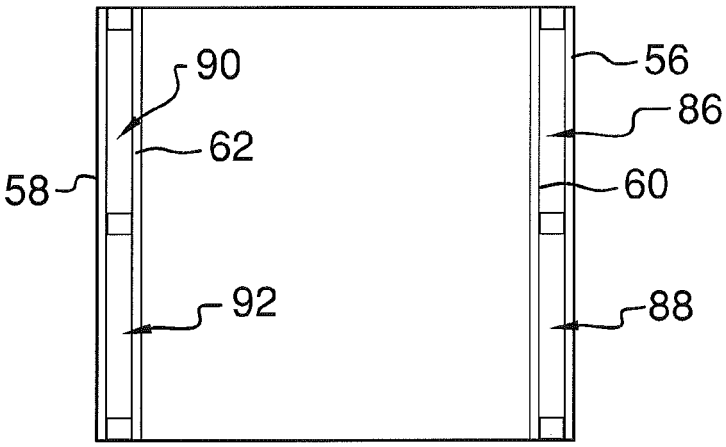
FIG. 6 is a diagrammatic cross-sectional view of a forced convention hanging clothes dryer constructed in accordance with the principles of at least one embodiment of the invention illustrating a recycle air duct configuration.

As further illustrated here, and briefly discussed above, first and second right side recycle air ducts 86 and 88 are formed by the horizontally spaced exterior side panel 56 and the interior side panel 60. Recycle air ducts 86 and 88 vertical extend the side of the cabinet 12 between the vertical frame members forming the corresponding side of the dryer frame 52. Likewise, the first and second left side recycle air ducts 90 and 92 are formed by the horizontally spaced exterior side panel 58 and the interior side panel 62. Recycle air ducts 90 and 92 vertical extend the side of the cabinet 12 between the vertical frame members forming the corresponding side of the dryer frame 52. This configuration is further illustrated diagrammatically in FIG. 6. As discussed above, the interior side panels 60 and 62 are vertically shorter than the exterior walls to allow air flow in at the top and into recycle air ducts 86, 88, 90 and 92.

Referring back to FIG. 5, air duct 72 includes a room air inlet 100 that is aligned and registered with room air opening 28 to receive ambient air and a recycle air inlet 102 that is aligned and registered with recycle air duct 90 to receive recycled air. Air duct 72 delivers ambient air and recycled air to forced draft fan 72. Likewise, air duct 74 includes a room air inlet 104 that is aligned and registered with room air opening 30 to receive ambient air and a recycle air inlet 106 that is aligned and registered with recycle air duct 92 to receive recycled air. Air duct 74 delivers ambient air and recycled air to forced draft fan 74. Similarly, air duct 78 includes a room air inlet 108 that is aligned and registered with room air opening 32 to receive ambient air and a recycle air inlet 110 that is aligned and registered with recycle air duct 86 to receive recycled air. Air duct 76 delivers ambient air and recycled air to forced draft fan 76. Likewise, air duct 80 includes a room air inlet 112 that is aligned and registered with room air opening 34 to receive ambient air and a recycle air inlet 114 that is aligned and registered with recycle air duct 88 to receive recycled air. Air duct 80 delivers ambient air and recycled air to forced draft fan 78.

Figure 7:
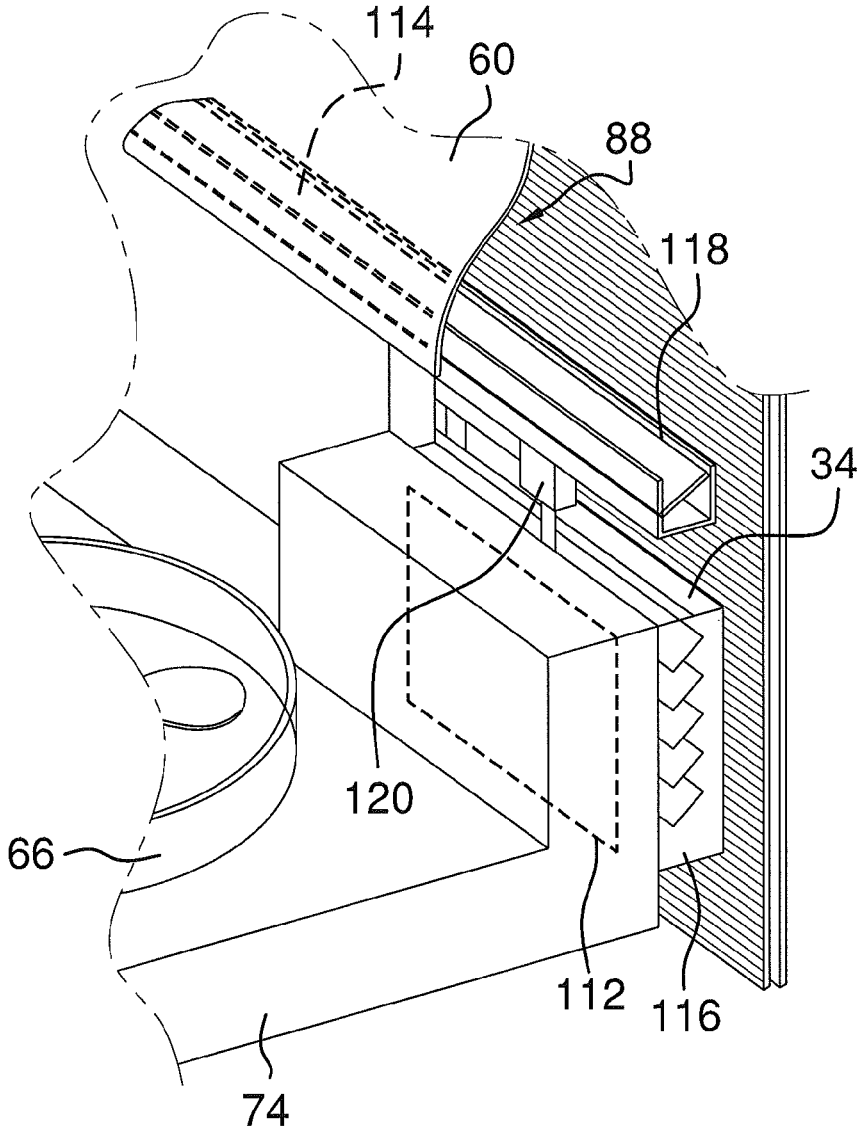
FIG. 7 is a diagrammatic, enlarged perspective view of a forced draft fan, recycle air duct and ambient air duct configuration including associated recycle air duct damper and ambient air duct damper.

Turning now to FIG. 7, there is diagrammatically illustrated the forced draft fan 66, the duct 74, a room air damper 116, and a recycled air damper 118 (interior side panel 60 is partially removed for purposes of illustrative clarity). It is to be understood, while the following description is made with specific reference to the forced draft fan 66, the duct 74, the room air damper 116 and the recycled air damper 118, the construction and arrangement with regard to the remaining three fan assemblies is the same, and accordingly, they do not require discussion. The room air damper 116 connects the room air inlet 112 and the room air opening 34 and is operable to control the flow of air from the room air opening into the fresh air inlet duct work. The recycled air damper 118 connects the recycled air duct 88 to the recycle air inlet 114 and is operable to control the flow of recycle air from the recycled air duct into the duct 74. An important aspect to embodiments of the invention is found in that the room air damper 116 and the recycled air damper 118 are operated simultaneously and inversely, in open and closed positions. Stated otherwise, as the room air damper 116 is opened to allow fresh air supply to the fans, the recycled air damper 118 is closed to stop the flow of recycle air back to the forced draft fans. As shown here, a single damper motor 120A is operably connected to both the recycled air damper 118 and the room air damper 116. Motor 120A is operated to affect the opening and closing of both the recycled air damper 118 and the room air damper 116. It is understood motor 120A may take various forms and configurations to operate the dampers. Further, it is possible that two separate motors, one each for each damper may be employed as a substitute for the single motor construction as illustrated. To this end, the main scope of this aspect is found in the alternately inversed positions, during various stages of programmed operation of the dampers regardless of the motor utilized to affect the control.

Figure 8:
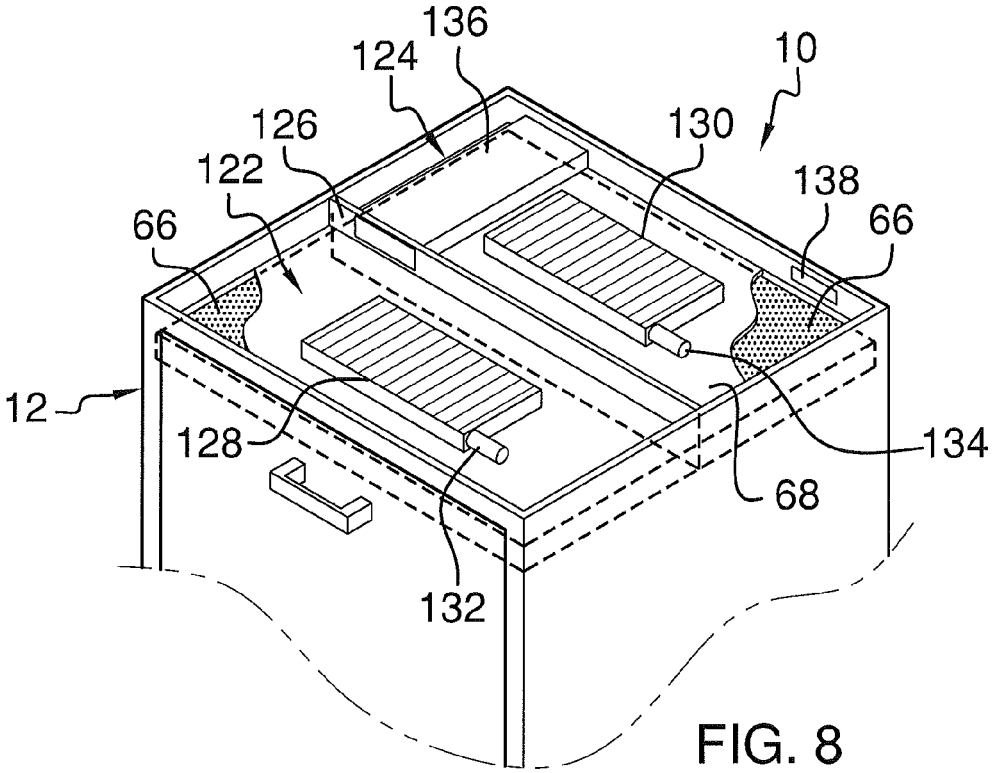
FIG. 8 is a diagrammatic, top perspective view of a forced convention hanging clothes dryer constructed in accordance with the principles of at least one embodiment of the invention illustrating a top plenum with panels removed for purpose of illustrative clarity.

With reference to FIG. 8, dryer 10 further includes discharge air plenums 122 and 124 disposed at a top end of the cabinet 12 (the exterior top 64 panel is removed for purpose of illustrative clarity). Air plenums 122 and 124 are separated by a vertical dividing wall 126. Dividing wall 126 is positioned to correspond with and to lie in the same vertical plane as the removable dividing panel 29 (not illustrated) when the drying rack 16 is completely slid inwardly into the drying chamber 14. Top plate 66 is slightly below each air plenum 122 and 124 and is perforated to permit the flow of air from the drying chambers into Plenums 122 and 124. Top plate 66 may be perforated with a desired pattern and sizing according to particular and desired air flow patterns. Top plate 68 horizontally divides the plenums 122 and 124, and while not shown here, top plate 64 forms a top of each plenum. Discharge air damper 128 connects the upper and lower chambers of plenum 122 and is operable to control the flow of air from the lower chamber to the upper chamber thereof. Motor 132 is operably connected to discharge damper 128 and is operated to open and close the damper. Likewise, discharge air damper 130 connects the upper and lower chambers of plenum 124 and is operable to control the flow of air from the lower chamber to the upper chamber thereof. Motor 134 is operably connect to discharge air damper 130 and is operated to open and close the damper. Dampers 128 and 132 are independently operated accordingly to a desired dryer control.

Exhaust duct 136 of the exhaust duct assembly 48 is connected to the upper chamber of plenum 122 to receive exhaust air therefrom, and exhaust duct 138 of the exhaust duct assembly is connected to the upper chamber of plenum 124 to receive exhaust air therefrom. Each exhaust duct 136 and 138 may be fitted with a one-way damper valve that is operable to only permit air flow into the respective duct from the plenums. Referring to FIG. 4, exhaust ducts 136 and 138 form part of the exhaust duct assembly 48 which connects the dryer 10 to an external exhaust ducting for discharge of the exhaust air at a desired location, e.g. at an exterior location of a building.

Figure 11:
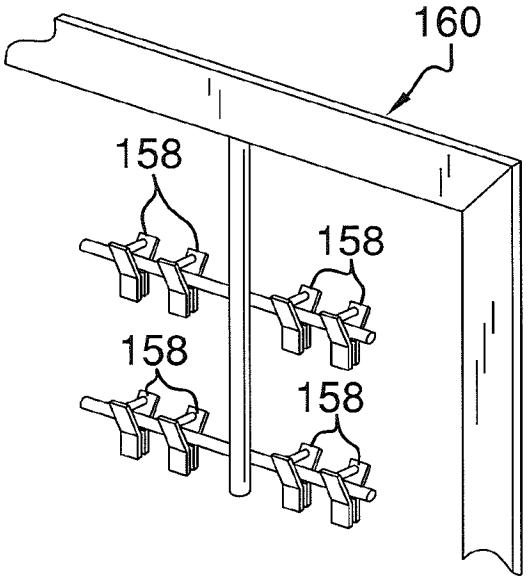
FIG. 11 is an enlarged diagrammatic perspective of spring clips of an embodiment of the hanger assembly.
Figure 9:
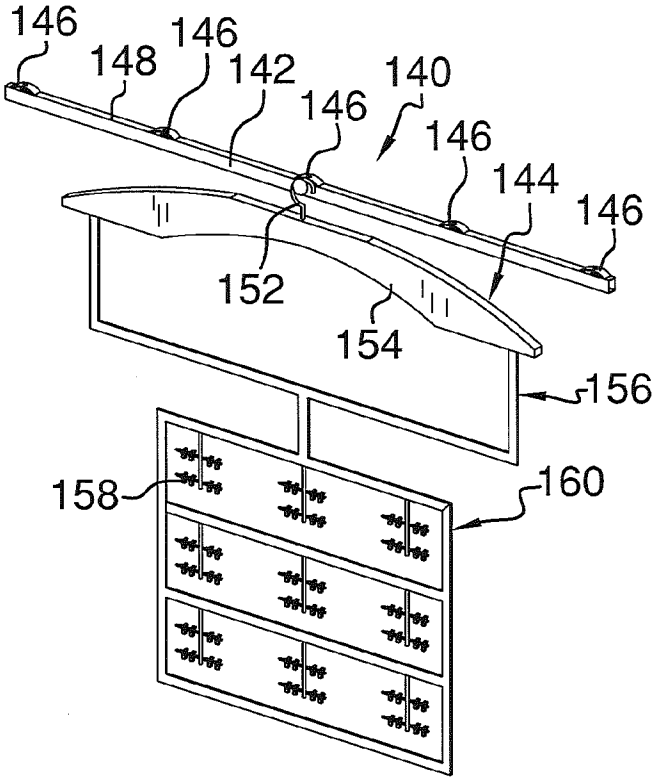
FIG. 9 is a diagrammatic perspective view of an embodiment of a hanger assembly of the forced convection clothes dryer of the invention.
Figure 10:
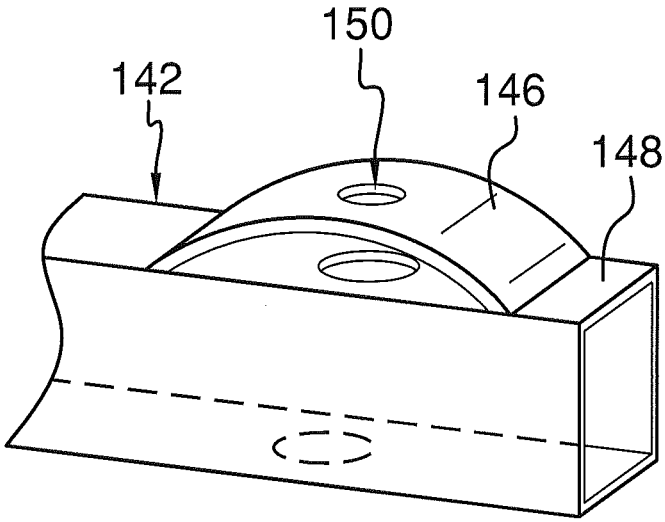
FIG. 10 is an enlarged diagrammatic perspective view of a cross bar of an embodiment of the hanger assembly.

Turning to FIGS. 9 to 11, in another aspect of embodiments of the invention there is provided an article hanger assembly 140 upon which articles to be dried may be hung and suspended in the dryer during a drying operation. The hanger assembly 140 includes a specially designed suspension member 142 and a specially designed garment hanger 144. Suspension member 142 is an elongated bar that is attached to and supported at opposite ends by the frame of the drying rack 16 such that the suspension member spans across the width of the drying rack (best seen in FIG. 1). The suspension member 142 may be slidably positioned across the drying rack 16, or removed as desired. Suspension member 142 provides a stable horizontally oriented support upon which articles to be dried may be folded over in a manner very similar to the hanging of a towel from a towel rod. The suspension member 142 a plurality of protrusions or bumps 146 spaced along a top face 148 thereof. Protrusions 146 serve to lift the material of an article draped over the suspension member from the top face 148 to enhance air flow across the surface of the material along its interface with the suspension member to promote faster drying. The suspension member 142 may further include a plurality of vertically extending air passages 150 spaced therealong that permit a flow of air through the suspension member to further promote drying. Air passages 150 may correspond to each protrusion 146.

Garment hanger 144 includes a conventional hanging hook 152 extending upwardly from a conventional shirt hanging cross member 154, a U-shaped fame 156 depending downwardly from the cross member for the draping of pants, shorts, skirts, etc., and depending downwardly from the U-shape frame a plurality of spring clips 158 supported upon an open frame work 160 for the attachment of smaller articles to the hanger assembly 140. The U-shaped frame 156 can snap into or out of garment hangar 144 to allow convenience for loading and unloading items on the frame. The hanging hook 152 can be sized, so that it can also be placed directly to hang on any common closet bar. This means a convenient single handling of many items, and by strategic hanging of items per bar, the bars can be placed directly into various closets without re-handling or removing of items. Because all hangars 144 and hanging bars 142 can be removed, as well as the center removable section 29, large household items such as cushions or pillows can be inserted and removed easily for gentle drying, that is not possible in a tumble dryer.

Figure 12:
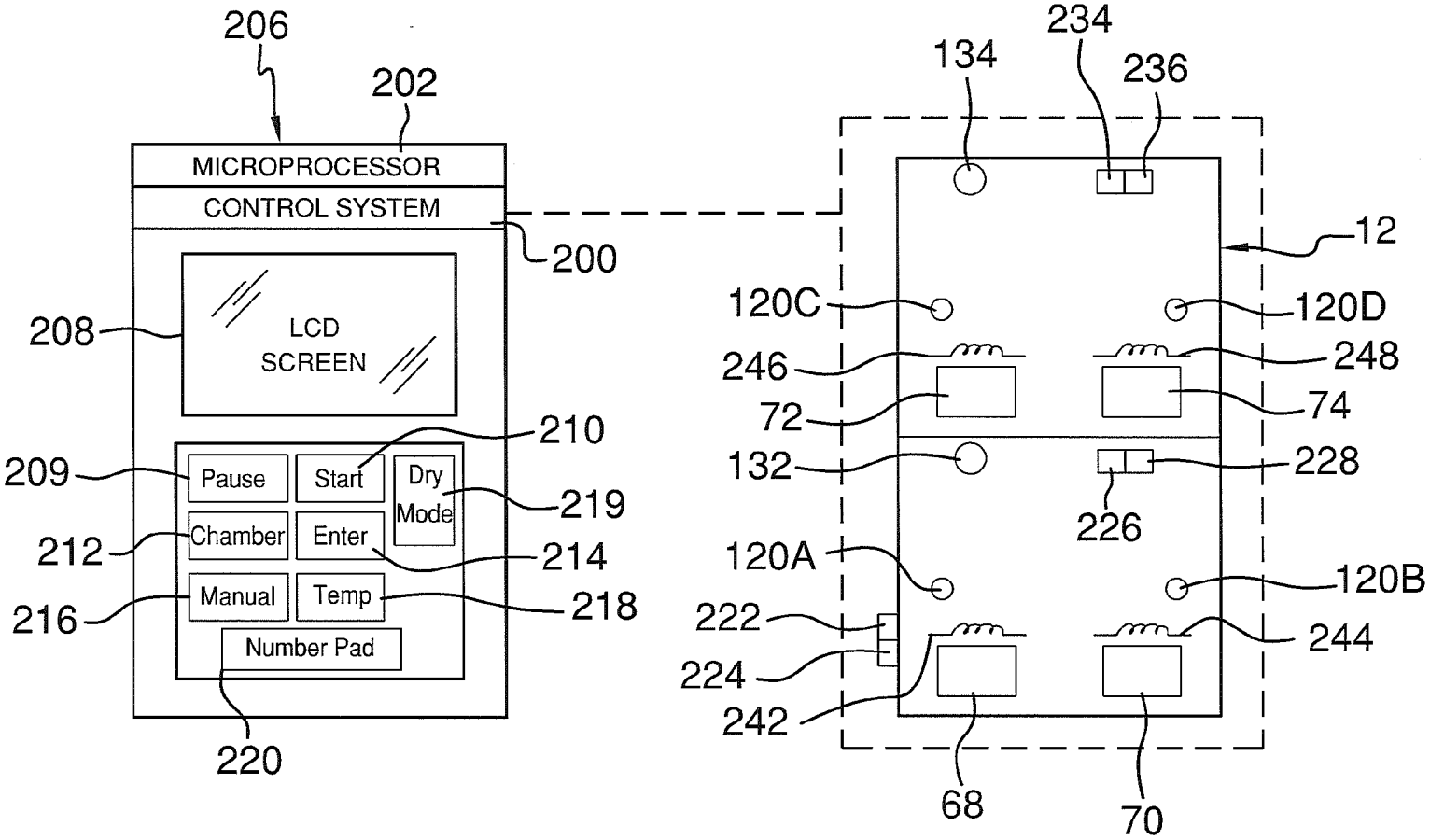
FIG. 12 is a schematic diagram of a control system and forced convection hanging clothes dryer constructed in accordance with the principles of at least one embodiment of the invention.

Referring to FIG. 12, dryer 10 further includes a control system 200 that includes a microprocessor 202 preprogrammed to provide the dryer with a variety of subsequently described operational modes and control sequences that provide the dryer with desirably enhanced operational flexibility and efficiency. Control system 200 also includes a user input touchpad input panel 206 that may be conveniently mounted on the exterior of the dryer cabinet 12 at a suitable location thereon. Input panel 206 may be connected with the control system 200 through a retractable data cable permitting the input panel 206 to be removably mounted on the exterior of the dryer cabinet 12 for retrieval by an operator for interaction therewith.

In the representatively illustrated form thereof, the input panel 206 has disposed on the face thereof a digital display (LCD or the like) 208 which may or may not be a touch panel. Digital display 208 is operated to display various status indicators and control selections of the operation of the dryer 10. In the instance the digital display 208 is a touch panel, various control input buttons may also be displayed for an operator to use to interface with the operation and control of the dryer 10. Further in the representatively illustrated form, the input panel 206 includes various function specific inputs that may be pressed by an operator, e.g. pause 209, start 210, dryer chamber selector 212, enter or select 214, manual mode 216, temperature select 218, drying mode select and a number pad 220. Of course, it is to be understood additional or less control selection buttons may be included on the input panel 206 as desired.

To facilitate desired operational modes and control sequences, the dryer 10 further includes an externally mounted temperature sensor 222 that senses the temperature of the ambient air, an externally mounted humidity sensor 224 that senses the humidity of the ambient air, a first drying chamber temperature sensor 226 that senses temperature within a first drying chamber as divided by panel 29 and a first drying chamber humidity sensor 228 that senses humidity within the first drying chamber, second drying chamber temperature sensor 234 that senses temperature within a second drying chamber as divided by panel 29 and a second drying chamber humidity sensor 236 that senses humidity within the second drying chamber Also the dryer 10 includes heating elements 242, 244, 246 and 248. Heating elements 242 and 244 are disposed across forced draft fans 68 and 70, respectively, for heating air discharged by each fan. Heating elements 246 and 248 are disposed across forced draft fans 72 and 74, respectively, for heating air discharged be each fan.

Figure 13:
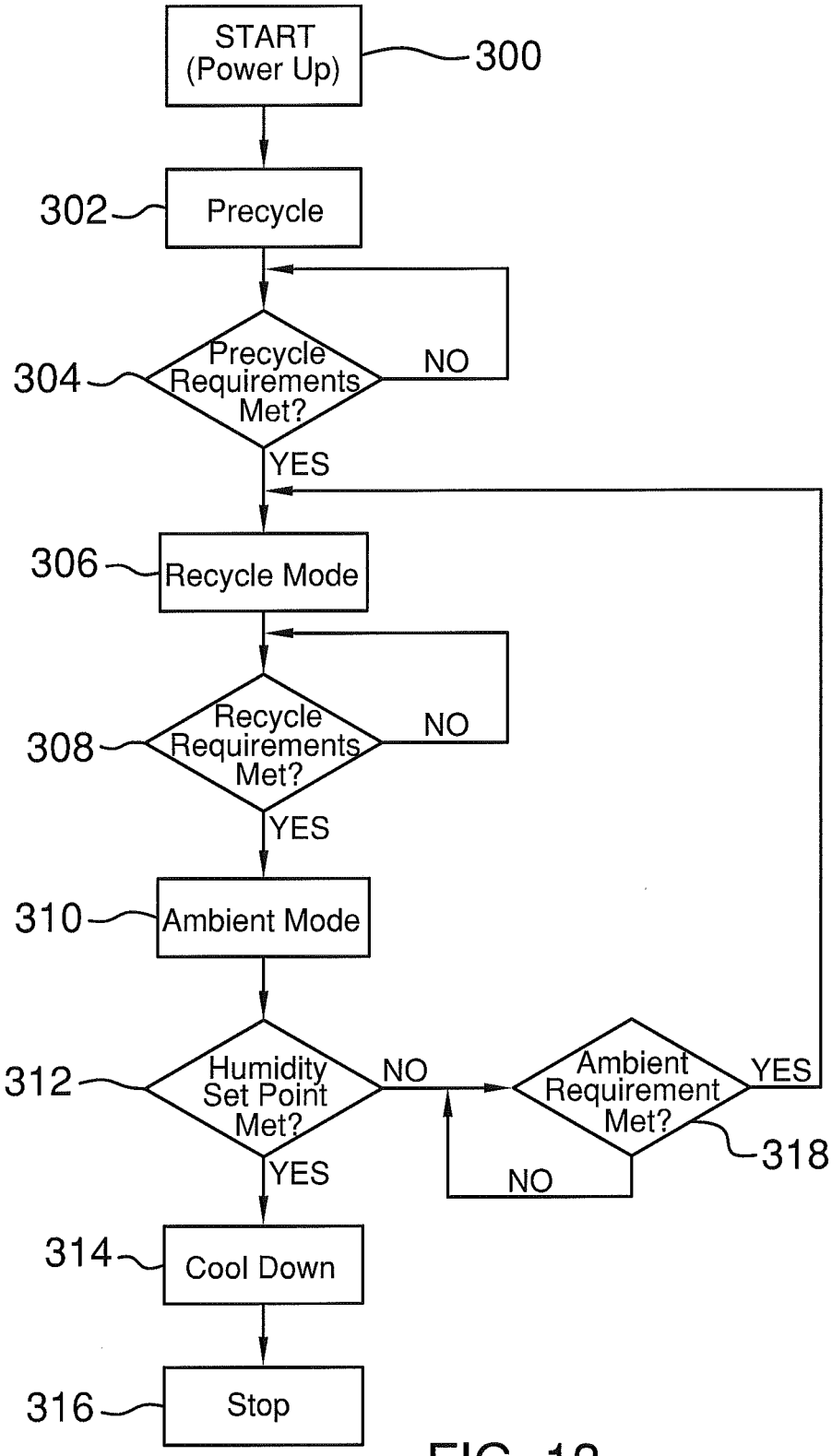
FIG. 13 is a schematic flow diagram illustrating various control techniques utilized in conjunction with the forced convection hanging clothes dryer and associated control system.

Turn now to the flow chart of FIG. 13, an exemplary mode and operational sequence of the dryer 10, carried out by the control system 200, will be more fully described. The dryer 10 is initially powered up at step 300 (by user selection of drying chamber 1, drying chamber 2 or joint drying chambers as desired by the user—for discussion herein chamber 1 is selected) after which a transfer is made to pre-cycle step 302.

At step 302, the control system 200 operates to ensure all dampers are in the correct position, before starting the forced draft fans. Accordingly, initially at this step, the fresh air damper will be fully open, the recycle damper will be fully closed, by energizing damper motors 120*a* and 120*b* and the exhaust damper will be fully open, by energizing damper motor 132. Once the control system 200 confirms the dampers are all in the correct position, then forced draft fans 68 and 70 will start, and draw fresh ambient air through the drying chamber and exhaust it, from the drying chamber through exhaust duct 136, whereby the fresh ambient air is passed across wet articles disposed in the drying chamber. After a predetermined time period, a query is made at step 304 as to whether the drying chamber humidity (as sensed by humidity sensor 228) is greater than a predetermined humidity, representatively a first humidity value greater than the ambient humidity as sensed by humidity sensor 222 or the drying chamber temperature (as sensed by temperature sensor 226) is below predetermined temperature set point.

If either of these conditions is met, the control system effects a transfer to step 306 at which an air-recycle mode is initiated to begin drying the articles disposed in the drying chamber.

However, if for any reason neither of the above conditions are met, then the program will determine that it may be shutting off prematurely. The program will then to go back to the start of step 302, Precycle. This will enable another timed air purge of the dryer to attempt, to raise the humidity inside the dryer, above the external humidity reading, or lower the ambient temperature inside the dryer, below the program start point. The program will do this twice, before shutting down the dryer, since the pre start conditions could not be met. As mentioned, this could be for a variety of reasons, including, mistakenly programming the wrong chamber, very light fabrics that dry within the precycle timed period, or incorrect loading of the dryer, or programming the wrong selection for the fabric to be dried, or ambient conditions, that coincide with the dryer start parameters for that program selection. This will be a safety feature, to ensure, the dryer is able to shutdown, in the event it cannot start the program, within its required parameters. An audible and visual alarm could warn the user of the occurrence.

In response to the air-recycle being initiated at step 306, the control system energizes damper motor 132 to close air exhaust duct, energizes damper motors 120*a* and 120*b* to close the respective ambient air dampers and open the respective air recycle dampers and energizes electric heating elements 242 and 244 (damper motors 120*a* and 120*b* are operate prior to damper motor 132). A transfer is then made to step 308 at which a query is made to whether the drying chamber humidity (as sensed by humidity sensor 228) is greater than a predetermined humidity (representatively a second humidity value greater than the ambient humidity as sensed by humidity sensor 222) or if the drying chamber temperature (as sensed by temperature sensor 228) is equal to or greater than a predetermined temperature (representatively 50° C.).

If either of these conditions is met, the control system effects a transfer to step 310 at which an ambient mode is initiated to purge the drying chamber of the recycled air with fresh ambient air. In response to the ambient mode being initiated at step 310, the control system 200 de-energizes damper motor 132 to open the air exhaust duct, de-energizes damper motors 120*a* and 120*b* to open the respective ambient air dampers and to open the associated air recycle dampers, and de-energizes heating elements 242 and 244 (damper motor 132 is operated prior to operating damper motors 120*a* and 120*b*).

After a predetermined time period, the control system effects a transfer to step 312 at which a query is made as to whether the sensed drying chamber humidity is equal to the sensed ambient humidity. If this condition is met, the control system effects a transfer to step 314 at which a cool down mode is initiated to lower the temperature of the articles disposed within the drying chamber to a temperature suitable for handling. In response to the cool down mode being initiated at step 314, the control system maintains energization of forced draft fans 68 and 70 to draw fresh ambient air into the drying chamber and exhaust it out of the exhaust duct, whereby the articles disposed within the drying chamber are cooled by the passages of the fresh ambient air. After a predetermined time period, the control system 200 effects a transfer to step 316 at which a stop mode is initiated to stop the operation of the dryer with respect to the drying chamber selected at step 300.

Returning to step 312, if the condition is not met, the control system 200 effects a transfer to step 318 at which a query is made as to whether the sensed drying chamber humidity is greater than a predetermined humidity, representatively the first humidity value great than the ambient humidity. If the higher humidity level still exists, the control system 200 effects a transfer to step 306 at which the recycle mode is once again initiated.

This process continues until it is terminated at step 316 to effect the efficient drying of the articles disposed within the drying chamber. It is understood, that the program will de-energize all components at the end of any program. As previously mentioned, while the above described exemplary mode and operational sequence was made in reference to only the first drying chamber the exemplary mode and operational sequence extends to the second drying chamber or a both drying chambers collectively acting as a larger single drying chamber. It should be understood, various modes and operational sequences may be implemented while remaining within the scope of the invention In embodiments, the dryer 10 may include a component failure indication to the operator. The component failure indication may be in the form of visual or audible indicators. The component failure indication may alert the operator to the need to service the dryer, and/or may include an indication to a specific component failure. In an embodiment monitored components may have a feedback signal to the control system 200 where the digital display on the screen may alert the user to a component, not working, and therefore be able to call a service person. By the user being able to explain what the key pad shows to the service center, a service person, can bring the correct replacements with him, reducing repeat service visits, due to lack of correct parts.

In embodiments, the control system 200 may require a user to enter a pin or passcode to open the dryer to insert garments, or at the end of the cycle to remove garments. This is also desirable, in the case where a person is using the dryer in a commercial Laundro Mat or apartment building for security of their clothing items. A reasonable time delay could be programmed, in the case of commercial applications to open the drawer, for other users.

In embodiments the drying rack 16 may be capable of being removed, similar to any desk drawer, in order to facilitate servicing of internal components.

In embodiment, the control system 200 may include a high temperature alarm that operates shut off all the heating elements, if for some reason, either drying chamber temperature, exceeds the programmed temperature. In manual mode, the maximum temperature allowed will be the same as for the highest setting of the programmed modes.

In embodiments, the retractable key pad as mentioned is to allow persons with disabilities, or short reaching ability to access the key pad, from a sitting position.

A number of embodiments of the present invention have been described. Nevertheless, it will be understood that various modifications may be made without departing from the spirit and scope of the invention. Accordingly, other embodiments are within the scope of the following claims.

What is claimed is:

1. A forced convection hanging clothes dryer, comprising:

a cabinet having an interior drying chamber;

a drying rack slidably mounted to said drying cabinet and moveable between a retracted position wherein said drying rack is disposed within said interior drying chamber and an extended position wherein said drying rack is disposed exteriorly of said interior drying chamber, said drying rack configured to removably receive and retain a drying chamber dividing panel in a vertical orientation so as to divide the drying rack horizontally into two separate sections;

a drying chamber dividing panel removably receivable by said drying rack and dividing said interior drying chamber into separate horizontally disposed and vertically extending first and second drying chambers when said drying chamber dividing panel is received by said drying rack and said drying rack is in said retracted position; an article hanger assembly having a suspension member comprising an elongated bar removably and slidably attached at opposite ends to said drying rack; and a plurality of protrusions spaced along a top face of said suspension member that serve to lift material of an article draped over said suspension member to enhance air flow across the material along its interface with said suspension member, wherein said suspension member includes a plurality of vertically extending air passages, one corresponding to each of said plurality of protrusions.

2. The forced convection hanging clothes dryer of claim 1, wherein said article hanger assembly further includes a garment hanger removably received by said suspension member.

3. The forced convection hanging clothes dryer of claim 2, wherein said garment hanger comprises a U-shaped frame removably attached to said garment hanger and an open frame work having a plurality of spring clips.

* * * * *